US007456796B2

(12) United States Patent
Nagayama et al.

(10) Patent No.: US 7,456,796 B2
(45) Date of Patent: Nov. 25, 2008

(54) GLASS ANTENNA FOR VEHICLE

(75) Inventors: Yoji Nagayama, Matsusaka (JP); Yasuo Takaki, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 0 days.

(21) Appl. No.: 11/667,734

(22) PCT Filed: Mar. 17, 2006

(86) PCT No.: PCT/JP2006/005371

§ 371 (c)(1),
(2), (4) Date: May 15, 2007

(87) PCT Pub. No.: WO2006/103956

PCT Pub. Date: Oct. 5, 2006

(65) Prior Publication Data

US 2008/0106480 A1 May 8, 2008

(30) Foreign Application Priority Data

Mar. 29, 2005 (JP) ..... 2005-096361
Feb. 9, 2006 (JP) ..... 2006-032946

(51) Int. Cl.
*H01Q 1/32* (2006.01)

(52) U.S. Cl. ..... 343/713; 343/704

(58) Field of Classification Search ..... 343/713, 343/704, 711, 712

See application file for complete search history.

(56) References Cited

U.S. PATENT DOCUMENTS 4,954,797 A * 9/1990 Shinnai et al. ..... 343/704
5,083,134 A * 1/1992 Saitou et al. ..... 343/713
5,101,212 A * 3/1992 Shinnai et al. ..... 343/713
5,185,612 A * 2/1993 Tsukada et al. ..... 343/713
5,933,119 A * 8/1999 Fujii et al. ..... 343/713

FOREIGN PATENT DOCUMENTS

| | | | |
|---|---|---|---|
| JP | 2-13311 | U | 1/1990 |
| JP | 06-224613 | A | 8/1994 |
| JP | 7-22826 | A | 1/1995 |
| JP | 7-297618 | A | 11/1995 |
| JP | 10-242730 | A | 9/1998 |
| JP | 2001-313513 | A | 11/2001 |

* cited by examiner

OTHER PUBLICATIONS

International Search Report dated Apr. 18, 2006 with English translation (Five (5) pages).

*Primary Examiner*—Tho G Phan
(74) *Attorney, Agent, or Firm*—Crowell & Moring LLP

(57) ABSTRACT

There is provided an antenna formed on at least upper blank space of defogging heating strips of a rear window glass of a vehicle. The antenna is a vehicular glass antenna including an AM broadcast wave receiving antenna which has at least two horizontal strips formed to have a space therebetween, and a vertical strip connecting the two horizontal strips in the vicinity of a midpoint of each horizontal strip, and in which an extension line extends in a horizontal direction from the vicinity of a midpoint of the vertical strip to the vicinity of a vertical edge of a flange and connects to a first feed point; and an FM broadcast wave receiving antenna having at least one horizontal strip extending from a second feed point formed in the vicinity of the first feed point, and characterized in that at least one horizontal strip of the FM broadcast wave receiving antenna is adjacent to one end of either horizontal strip of the two horizontal strips of the AM broadcast wave receiving antenna to achieve a capacitive coupling.

7 Claims, 7 Drawing Sheets

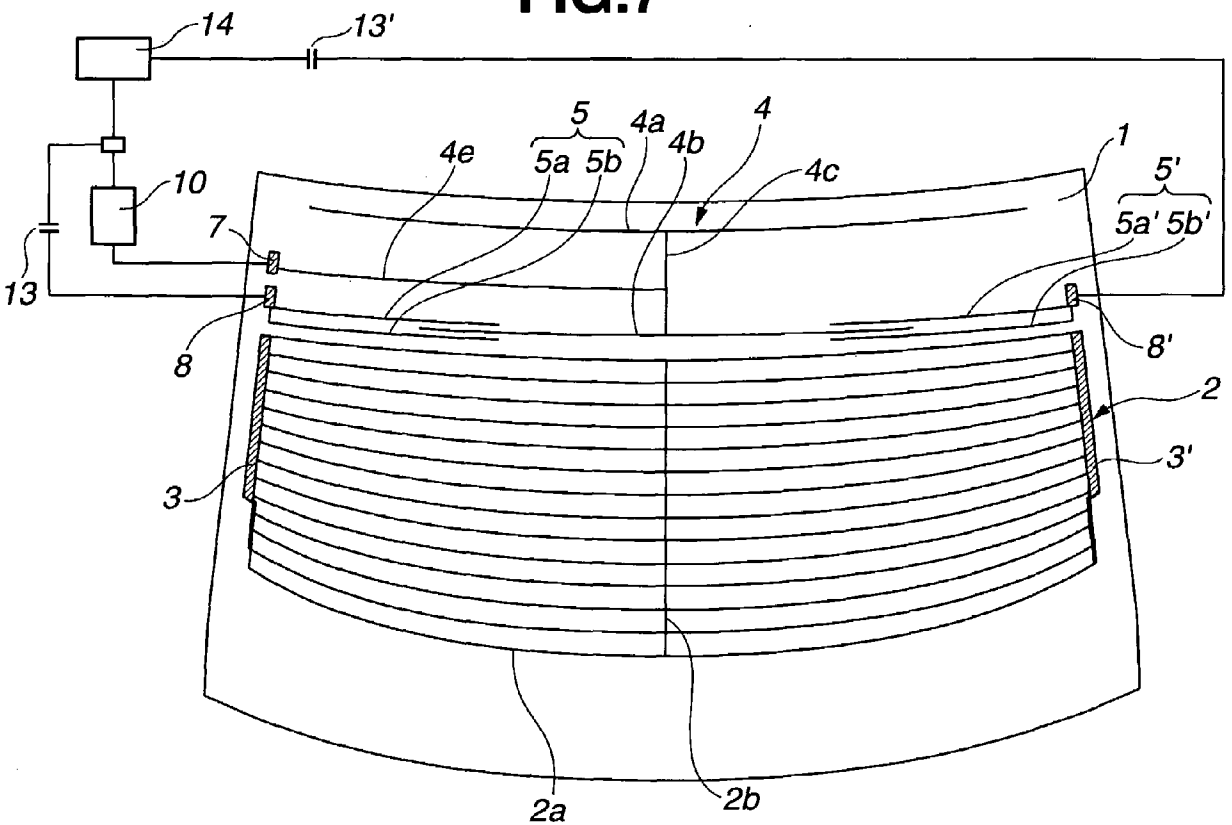
FIG.7
FIG.8
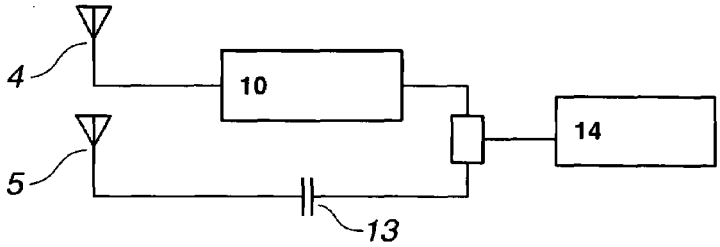

GLASS ANTENNA FOR VEHICLE

TECHNICAL FIELD

The present invention relates to a glass antenna that is formed on a rear window glass of vehicles such as automobiles and receives AM radio broadcast waves and FM radio broadcast waves, particularly to a glass antenna that is suitable for receiving radio waves of FM radio broadcast waves.

BACKGROUND OF THE INVENTION

Hitherto, glass antenna for receiving AM radio broadcast waves and FM radio broadcast waves has often been formed on a rear window glass of an automobile, since it requires a relatively large area for obtaining a good reception gain. Furthermore, since a rear window glass of an automobile is often formed on its central region with defogging heating strips, in case that a glass antenna is formed on a rear window glass, it has been forced to be formed on a blank space above or below the defogging heating strips.

Furthermore, in most cases, reception has been conducted by forming one antenna on a blank space above the defogging heating strips for receiving AM broadcast waves and FM broadcast waves, and an antenna of these AM-band/FM-band has taken a grounded antenna pattern having one feed point.

Furthermore, in the case of receiving radio waves of AM radio broadcast waves and radio waves of FM radio broadcast waves by a glass antenna, as shown in FIG. 9, in many cases, an antenna amplifier has been provided generally between an antenna feed point and a tuner, and an electromotive force insufficient to be input to the tuner has been amplified, and it has been input to the tuner.

Alternatively, as shown in FIG. 10, an impedance matching circuit has been formed in order to minimize the reduction loss of the reception gain by a feeder line between the antenna feed point and the tuner to maintain the electromotive force that becomes sufficient to be input to the tuner, thereby inputting it to the tuner.

In the case of sharing antennas of AM broadcast waves and FM broadcast waves, in many cases, with respect to the amplifier, an AM broadcast wave amplifier and an FM broadcast wave amplifier are separately provided, thereby amplifying the received power and then inputting it to the tuner. Alternatively, also with respect to the impedance matching circuit, in many cases, the reduction due to the loss of the reception sensitivity is suppressed by an AM broadcast wave impedance matching circuit and an FM broadcast wave impedance matching circuit in the route that transmits radio waves received by an antenna to the tuner.

As one in which a glass antenna is formed on an upper blank space of a vehicular rear window glass and an amplification is conducted by an amplifier, for example, there is described in Patent Publication 1 an amplifier attachment structure of a vehicular glass antenna, which has a glass antenna in which an antenna conductor is formed at a predetermined position of a vehicular window glass plate and an amplifier for amplifying the reception sensitivity of the glass antenna, and in which the amplifier is directly connected to a feed terminal portion of the glass antenna by means such as soldering, brazing or a conductive adhesive bonding, thereby reducing the gain loss due to the capacity loss at a feed line portion between the glass antenna and the amplifier.

With respect to forming an impedance matching circuit between a vehicular glass antenna and a tuner, for example, Patent Publication 2 describes a four-terminal circuit as an impedance matching circuit.

Patent Publication 1: a microfilm of Japanese Utility Model Application 63-89982 (Japanese Utility Model Laid-open Publication 2-13311)

Patent Publication 2: Japanese Patent Laid-open Publication 2001-313513

SUMMARY OF THE INVENTION

The above-mentioned Patent Publication 1 describes a structure in which a single circuit antenna as an antenna for receiving AM broadcast waves and FM broadcast waves is formed on a blank space of a rear window glass of an automobile, and in which an amplifier for amplifying the reception sensitivity of glass antenna is attached to a feed terminal of the antenna.

However, in such a case that an AM antenna and an FM antenna are formed into the same antenna, it is necessary to conduct a tuning for satisfying both frequency bands of AM band and FM band. Therefore, there has been a problem in which the tuning operation becomes complicated to increase man-hour.

Furthermore, different amplifier circuits are provided for receiving frequency bands, that is, for AM broadcast band and FM broadcast band. It is necessary to make the AM broadcast wave amplifier and the FM broadcast wave amplifier have different circuits. A wave separation into both frequency bands of AM broadcast band and FM broadcast band is once conducted, and they are respectively amplified by an AM broadcast wave amplifier and an FM broadcast wave amplifier, followed by combination. Therefore, the external size of the antenna amplifier became large, and its appearance was also inferior in the case of attaching it at the feed point or its vicinity. Even if it is formed on an inner side of an interior member of a side pillar portion of a rear window, not only it became an obstacle, but also its production cost was never low.

The present invention provides, in an antenna that is formed on a blank space of defogging heating strips of a rear window glass of an automobile, an antenna that solves the above problems and particularly does not require an FM radio broadcast wave amplifier or matching circuit, while making the reception gain of FM radio broadcast waves high.

According to the present invention, there is provided an antenna formed on at least an upper blank space of defogging heating strips of a rear window glass of a vehicle, the antenna being a vehicular glass antenna comprising an AM broadcast wave receiving antenna which has at least two horizontal strips formed to have a space therebetween, and a vertical strip connecting the two horizontal strips in the vicinity of a midpoint of each horizontal strip, and in which an extension line extends in a horizontal direction from the vicinity of a midpoint of the vertical strip to the vicinity of a vertical edge of a flange and connects to a first feed point; and an FM broadcast wave receiving antenna having at least one horizontal strip extending from a second feed point formed in the vicinity of the first feed point, and characterized in that at least one horizontal strip of the FM broadcast wave receiving antenna is adjacent to one end of either horizontal strip of the two horizontal strips of the AM broadcast wave receiving antenna to achieve a capacitive coupling.

BRIEF DESCRIPTION OF THE DRAWINGS

FIG. 7 is a front view showing Example 7 formed on a vehicular rear window glass of the present invention.

FIG. 8 is a system connection view from AM antenna/FM antenna to tuner of the present invention.

DETAILED DESCRIPTION

Figure 1:
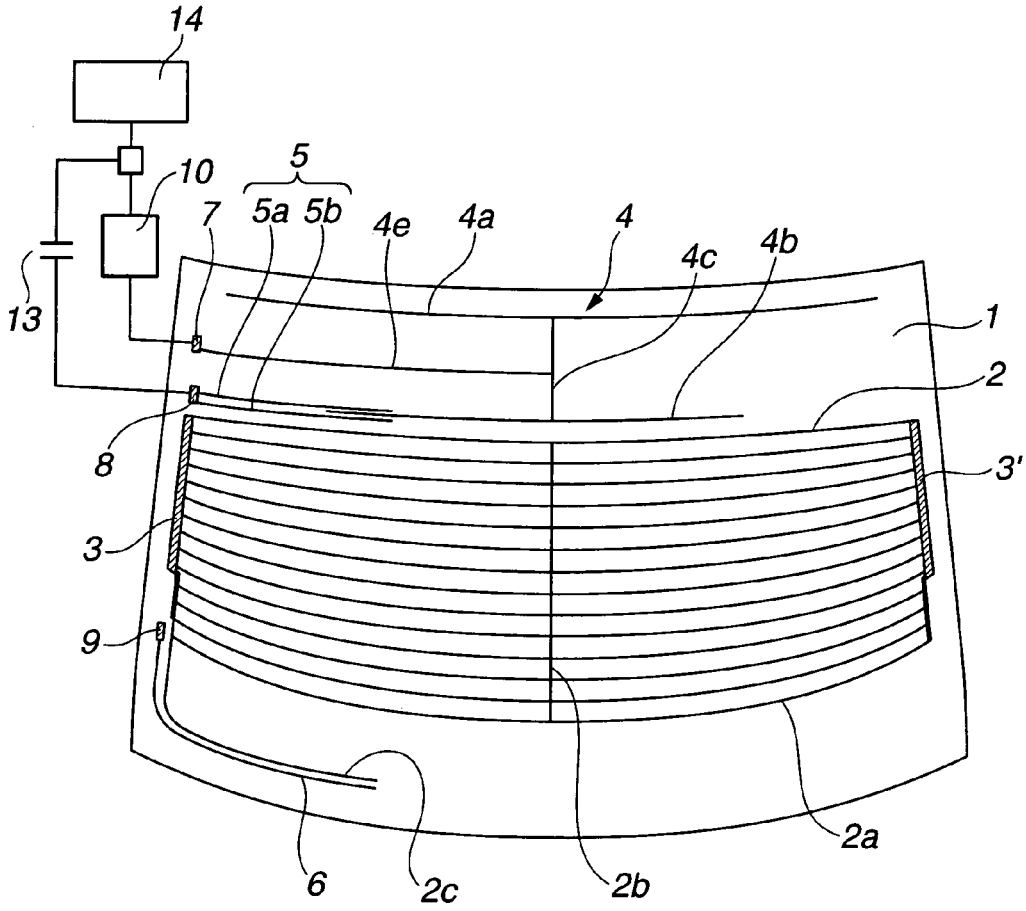
FIG. 1 is a front view showing Example 1 formed on a vehicular rear window glass of the present invention.

A capacitive coupling was achieved by positioning at least one horizontal strip of an FM broadcast wave receiving antenna adjacent to one end of either horizontal strip of two horizontal strips of an AM broadcast wave receiving antenna formed on a blank space of a rear window glass of a vehicle preferably in a manner to interpose it between two horizontal strips. With this, the reception sensitivity of the FM broadcast wave receiving antenna was greatly improved, and it became unnecessary to connect an amplifier and an impedance matching circuit between the second feed point of the FM broadcast wave receiving antenna and the tuner.

In this way, it was separated into two antennas for receiving AM broadcast waves and FM broadcast waves. With this, it became only necessary to independently respectively tune the AM broadcast wave receiving antenna and the FM broadcast wave receiving antenna, the tuning operation became easy, and the tuning became possible by fewer man-hours.

In conventional way, an AM broadcast wave band amplifier and an FM broadcast wave band amplifier were put into a single receiving case, and it was disposed in the vicinity of a pillar of a rear window glass. However, it became unnecessary to have an FM broadcast wave band amplifier that had occupied most of the volume of the receiving case. With this, not only the size of the receiving case became remarkably compact by a factor of about several numbers, but also it became possible to greatly reduce the production cost due to the necessity of only an AM broadcast wave amplifier.

The present invention provides an antenna in which an antenna 4 for receiving AM broadcast wave band radio waves and an antenna 5 for receiving FM broadcast wave band radio waves are formed on a blank space above defogging heating strips 2 of a vehicular rear window glass 1 to have an adjacent position and separate systems.

The defogging heating strips 2 are formed of a plurality of generally horizontal heating strips 2*a* that are disposed in parallel in a central region of the vehicular rear window glass 1 and are connected at their both ends with conductive bus bars 3, 3'.

Figure 2:
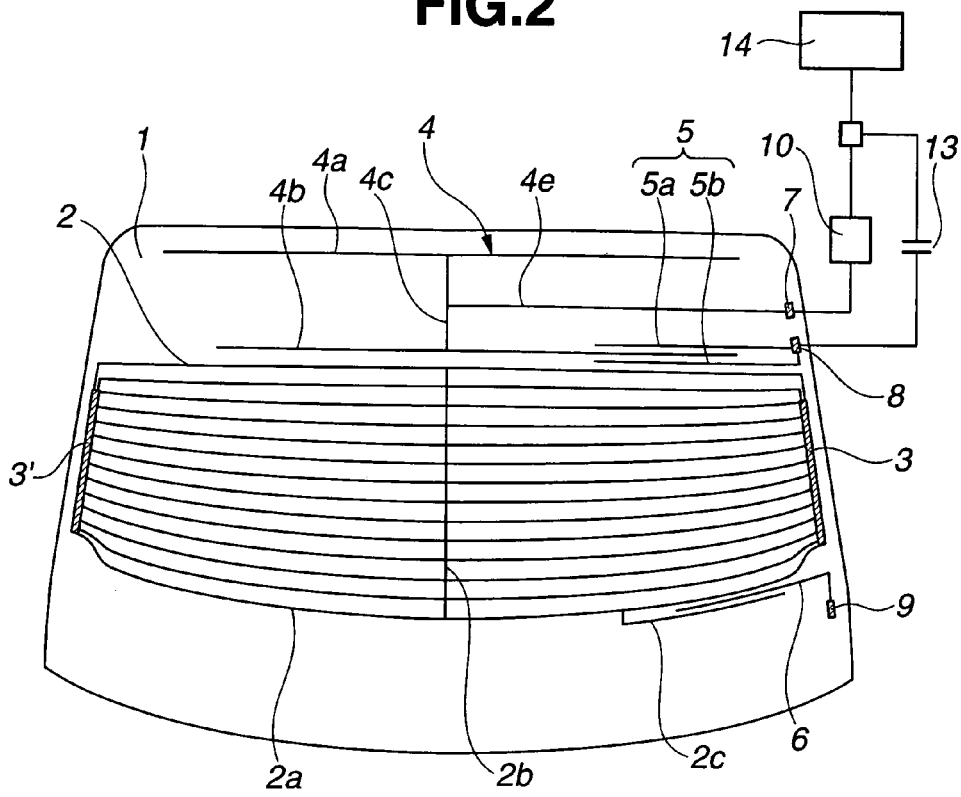
FIG. 2 is a front view showing Example 2 formed on a vehicular rear window glass of the present invention.
Figure 3:
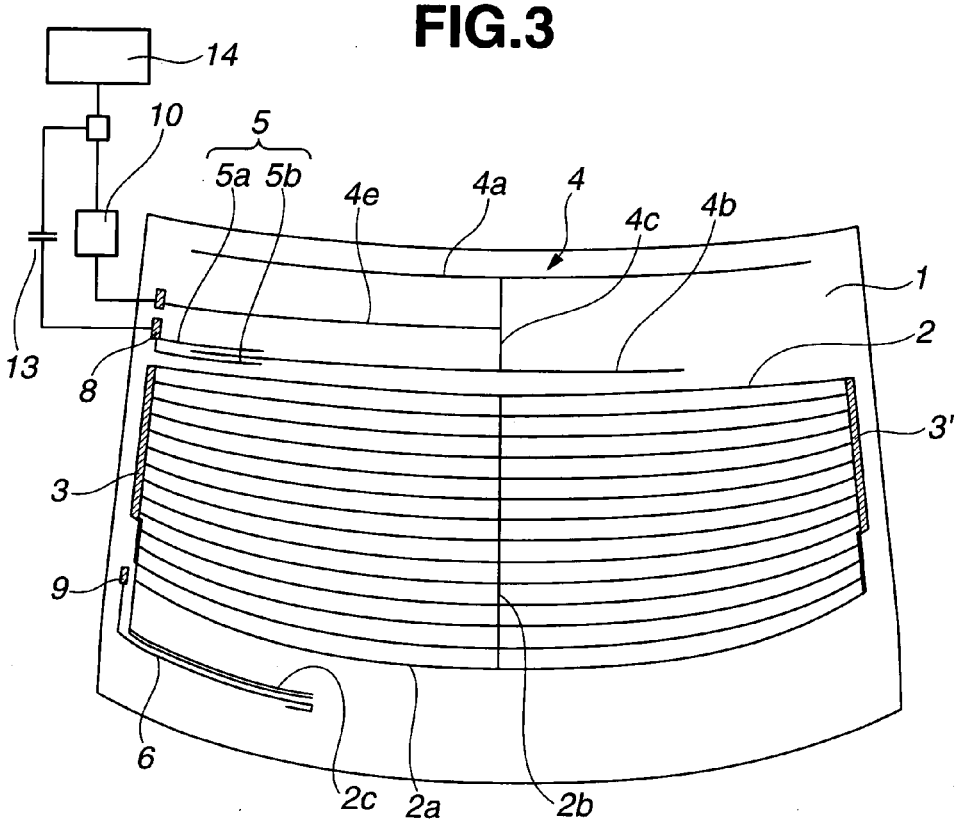
FIG. 3 is a front view showing Example 3 formed on a vehicular rear window glass of the present invention.

As shown in FIG. 1 to FIG. 3, the AM broadcast wave receiving antenna 4 is one which has on a blank space above the defogging heating strips 2 of the vehicular rear window glass at least two horizontal strips 4*a*, 4*b* formed to have a space therebetween and a vertical strip 4*c* that connects the two horizontal strips 4*a*, 4*b* together in the vicinities of midpoints of the two respective horizontal strips 4*a*, 4*b*, and in which an extension line 4*e* extends in a horizontal direction from the vicinity of a midpoint of the vertical strip 4*c* to the vicinity of a vertical edge of a flange of the window glass and connects to a first feed point 7.

The vertical strip 4*c* that connects the two horizontal strips 4*a*, 4*b* together is positioned in the vicinity of each midpoint of the two horizontal strips 4*a*, 4*b*. In some cases, however, each midpoint of the two horizontal strips 4*a*, 4*b* deviates leftward or rightward, and they may not necessarily be the midpoint positions. Although the vicinity of the midpoint position refers to a position of ±100 mm of each midpoint position of the horizontal strips 4*a*, 4*b*, it may be the position of ±200 mm of each midpoint position.

The FM broadcast wave receiving antenna 5 is formed of one horizontal strip or at least two horizontal strips 5*a*, 5*b* extending from a second feed point 8 formed in the vicinity of the first feed point 7. In case that the FM broadcast wave receiving antenna 5 is formed of at least two horizontal strips 5*a*, 5*b*, they are formed to achieve a capacitive coupling by making them adjacent in a manner to vertically interpose one lateral end of either horizontal strip of the at least two horizontal strips 4*a*, 4*b* of the AM broadcast wave receiving antenna 4 by a predetermined length and a predetermined distance.

Figure 5:
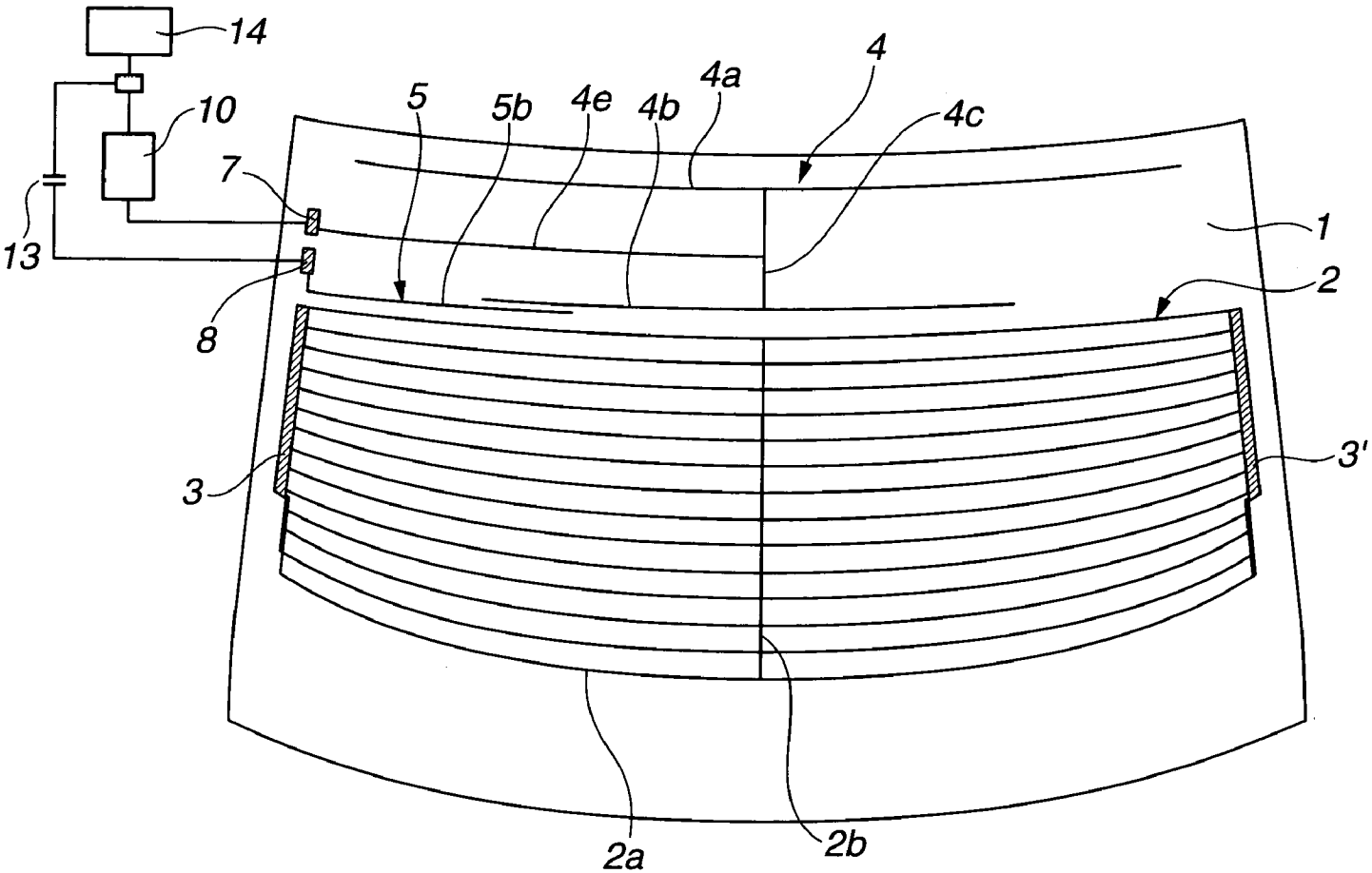
FIG. 5 is a front view showing Example 5 formed on a vehicular rear window glass of the present invention.

As shown in FIG. 5, in case that the FM broadcast wave receiving antenna 5 is formed of one horizontal strip 5*b* (or 5*a*) extending from the second feed point 8, it may be formed to achieve a capacitive coupling by making it adjacent on the upper side or lower side of a lateral one end of either horizontal strip of the at least two horizontal strips 4*a*, 4*b* of the AM broadcast wave receiving antenna 4 by a predetermined length and a predetermined distance.

Alternatively, as shown in FIG. 8, there was achieved a connection from the first feed point 7 of the AM broadcast wave receiving antenna 4 to the tuner 14 via the AM broadcast wave band amplifier 10, and there was achieved a direct connection from the second feed point 8 of the FM broadcast wave receiving antenna 4 to the tuner, not via an FM broadcast wave band amplifier 11 or an impedance matching circuit 12.

It is preferable to adjust respective lengths from the feed point of the two horizontal strips 5*a*, 5*b* extending from the second feed point 8 of the FM broadcast wave receiving antenna 5 to 200-400 mm in case that it is used as an FM broadcast wave receiving antenna 5 for the inside of Japan of a frequency of 76-90 MHz band and to 150-300 mm in case that it is used as an FM broadcast wave receiving antenna 5 for North America of a frequency of 88-108 MHz band.

It is good that the length of the strips of a portion which achieves a capacitive coupling and at which the horizontal strip 5*a*, 5*b* of the FM broadcast wave receiving antenna 5 and the horizontal strip 4*a*, 4*b* of the AM broadcast wave receiving antenna 4 are adjacent to each other is adjusted to 50-300 mm and that the distance between the strips of the portion which achieves a capacitive coupling and at which they are adjacent is adjusted to 5-30 mm, preferably 5-15 mm.

It is also possible to form an FM broadcast wave receiving sub-antenna 6 on a blank space below the defogging heating strips 2 of the rear window glass 1 of a vehicle. Although the FM sub-antenna 6 is formed on the blank space below the defogging heating strips 2, a third feed point 9 that is a feed point of the sub-antenna 6 may be formed at a position below either one of the bus bars 3, 3' of the defogging heating strips 2.

In the FM broadcast wave receiving sub-antenna 6, a horizontal strip of the sub-antenna 6 is made to be adjacent to either one of a heating strip 2*a* positioned on the side of the lowest strip of the defogging heating strips 2, or a horizontal strip branched from the lowest heating strip 2*a*, or a strip extended from the bus bar, thereby achieving a capacitive coupling. With this, radio waves for FM broadcast waves that are received by the defogging heating strips 2 are picked up by the FM broadcast wave receiving sub-antenna 6, thereby improving the reception gain.

It is preferable that a diversity reception by such FM broadcast wave receiving sub-antenna 6 with the FM broadcast wave receiving primary antenna 5 is conducted, followed by input to the tuner 14, since the directional pattern is improved as compared with a case in which the reception is conducted by only the FM broadcast wave receiving antenna 5, followed by input to the tuner 14.

The defogging heating strips 2 are formed on a central region of the rear window glass 1. Generally horizontal heating strips 2*a* are disposed generally horizontally by a plural number. Their both ends are connected together by conductive bus bars 3, 3'. Electricity is applied by a direct current power source not shown in the drawings, thereby achieving heating.

A vertical strip 2*b* that connects respective general midpoints of the defogging heating strips 2 formed of a plurality of generally horizontal strips 2*a* is a neutral line. It is not a conductive strip for heating and defogging, but is one formed to make the defogging heating strips 2 function as an antenna to improve the reception gain. Thus, it is not necessarily essential.

Radio waves for AM broadcast waves are received by the AM broadcast wave receiving antenna 4, are amplified by the AM broadcast wave band amplifier 10 similarly to the past, and are input into the tuner 14. However, in the tuning of the AM broadcast wave receiving antenna 4, it is not necessary to consider the reception of FM broadcast waves, and each strip may have a length that makes it possible to efficiently receive only radio waves of AM broadcast wave band range.

Figure 4:
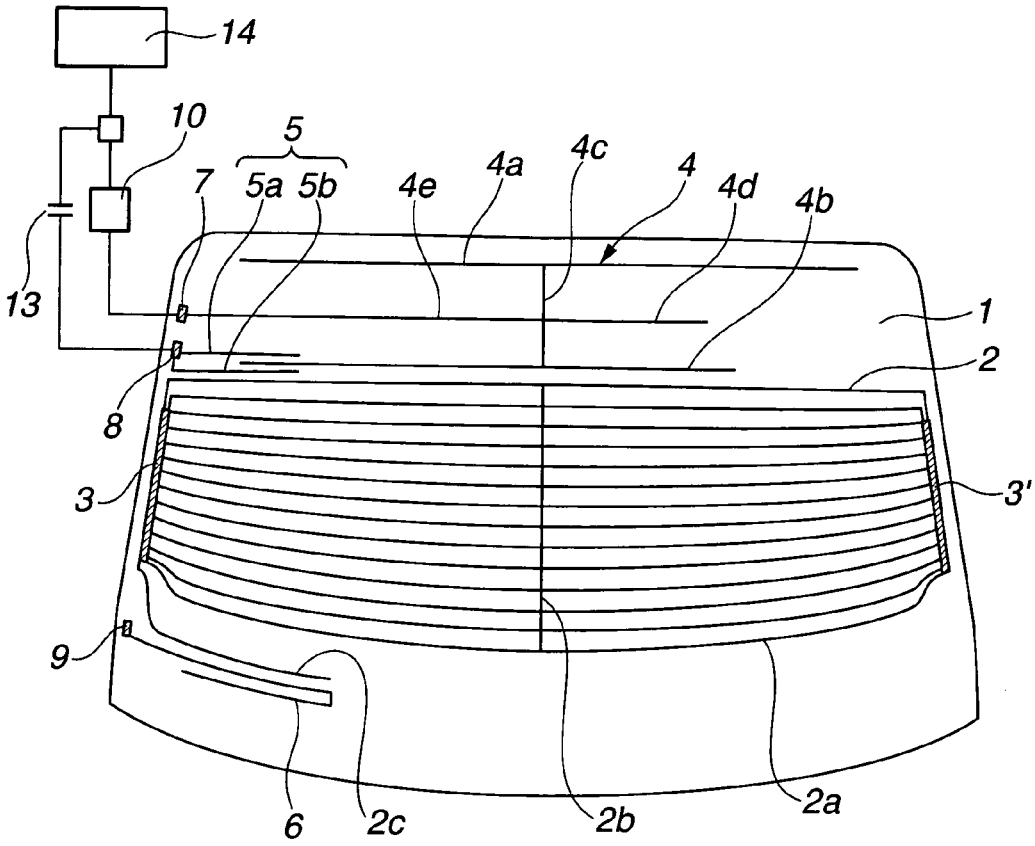
FIG. 4 is a front view showing Example 4 formed on a vehicular rear window glass of the present invention.

An additional horizontal strip 4*d* as shown in FIG. 4 is not necessarily essential. By forming the additional horizontal strip 4*d*, not only the reception sensitivity of AM broadcast wave band is improved, but also the impedance adjustment of the antenna for FM broadcast wave receiving band becomes possible. Thus, it effectively serves for broader band of the frequency characteristics and for improvement of the reception sensitivity.

It is desirable to adjust the distance between the bottom line 2*a* of the defogging heating strips 2 and the horizontal strip of the sub-antenna 6 to about 5-10 mm.

It is desirable to adjust the length of the sub-antenna 6 of the present invention to a range of 350-500 mm for the domestic band and to a range of 250-400 mm for the North America band.

Furthermore, as shown in FIG. 3 and FIG. 4, there is provided an effect of making the frequency characteristics of the receiving radio waves achieve a broader band until an FM band range from domestic band (76-90 MHz) to for the North America (88-108 MHz) by forming a folded strip that is folded from an end portion of the horizontal strip of the sub-antenna 6 to the vicinity of the end of the feed point 9 to have a C-shape.

Still furthermore, in addition to the two horizontal strips 4*a*, 4*b* of the AM broadcast wave receiving antenna 4, it is possible in the present invention to form one or two horizontal strips between the horizontal strips 4*a*, 4*b* to perpendicularly intersect the vertical strip 4*c*.

It is possible by the FM broadcast wave receiving antenna of the present invention to obtain a good reception sensitivity without connecting an amplifier or impedance matching circuit between the second feed point of the FM broadcast wave receiving antenna and the tuner. It is, however, needless to say that a further improvement of the reception sensitivity can be obtained by connecting an amplifier or impedance matching circuit.

In the following, operation of the present invention is described.

In the present invention, there are formed independent antennas that are separate from the AM broadcast wave-receiving antenna 4 and the FM broadcast wave-receiving antenna 5. Therefore, they can be tuned to have strip lengths suitable for respective received frequencies.

Furthermore, as shown in FIG. 8, similar to the past, radio waves for AM broadcast waves are amplified by the AM broadcast wave band amplifier 10 and input to the tuner 14. A capacitor for shielding the frequency band of AM radio broadcast waves was connected in series to the vicinity of the output side of the feed point 8 of the FM broadcast wave receiving antenna 5, in order to prevent the AM broadcast wave received signals from leaking to the tuner 14 side through the FM broadcast wave receiving antenna 5 that achieves a capacitive coupling together with the AM broadcast wave receiving antenna 4.

Figure 9:
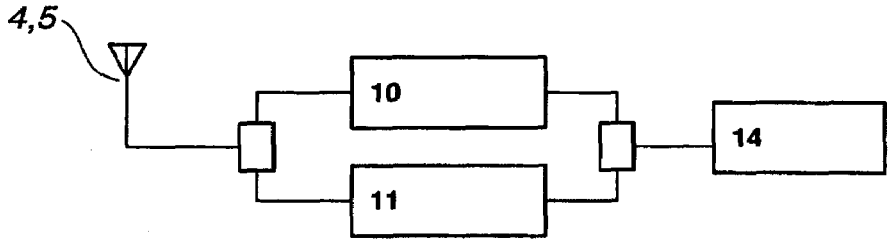
FIG.9 PRIOR ART
FIG. 9 is a conventional system connection view of a connection from AM/FM unified antenna to tuner via amplifier.
Figure 10:
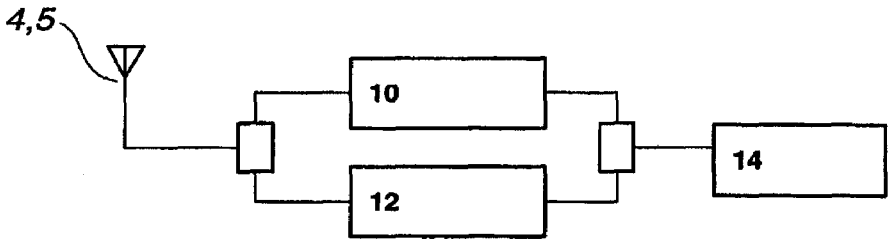
FIG.10 PRIOR ART
FIG. 10 is a conventional system connection view of a connection from AM/FM unified antenna to tuner via impedance matching circuit.

On the other hand, the FM broadcast wave antenna 5 can pick up FM broadcast wave band radio waves received by the AM broadcast wave antenna 4 by making the horizontal strip(s) of the FM broadcast wave receiving antenna 5 adjacent to a portion of the end of the horizontal strip 4*a*, 4*b* of the AM broadcast wave receiving antenna 4 to achieve a capacitive coupling or by making them adjacent thereto in a manner to interpose that between the two horizontal strips 5*a*, 5*b* of the FM broadcast wave receiving antenna 5 from both sides to achieve capacitive coupling. With this, it is possible to improve the reception sensitivity of the FM broadcast wave receiving antenna 5, and it is not necessary to connect an FM broadcast wave band amplifier 11 as shown in FIG. 9 or an impedance matching circuit 12 as shown in FIG. 10 between the second feed point 8 of the FM broadcast wave receiving antenna 5 and the tuner 14.

The number of the horizontal strips of the FM broadcast wave receiving antenna 5 may be one, and it may be made to be adjacent to a portion of the end of the horizontal strip 4*a*, 4*b* of the AM broadcast wave receiving antenna 4 to achieve a capacitive coupling. It is, however, preferable to make them adjacent in a manner to interpose a portion of the end of the horizontal strip 4*a*, 4*b* of the AM broadcast wave receiving antenna 4 between the two horizontal strips 5*a*, 5*b* of the FM broadcast wave receiving antenna 5 to achieve capacitive coupling. With this, a securer capacitive coupling is achieved, thereby obtaining a stable performance.

Interaction works and it is possible to improve the reception gain of the sub-antenna 6 by making the FM sub-antenna adjacent to the bottom line 2*a* of the heating conductive strips 2 as shown in FIG. 2, or to the horizontal strip 2*c* extending from the bus bar 3, 3' or the vicinity of the bus bar as shown in FIG. 1, FIG. 3 and FIG. 4, or to the horizontal strip 2*c* formed to branch from the bottom heating strip 2*a* of the defogging heating strips 2 as shown in FIG. 2.

Furthermore, there is provided an effect of making the frequency characteristics of the receiving radio waves achieve a broader band until an FM band range from domestic band (76-90 MHz) to for the North America (88-108 MHz) by forming a folded strip that is folded from a tip portion of the horizontal strip of the sub-antenna 6 to the vicinity of the end of the feed point 9 to have a C-shape, as shown in FIG. 3 and FIG. 4.

EXAMPLES

In the following, the present invention is described in detail with reference to the drawings.

Example 1

As shown in FIG. 1, an AM broadcast wave receiving antenna 4 and an antenna 5 for receiving domestic FM broadcast waves having a frequency of 76-90 MHz band were formed on an blank space above the defogging heating strips 2.

In the AM broadcast wave receiving antenna 4, two horizontal strips 4*a*, 4*b* formed to have a space therebetween are connected at respective midpoint vicinities with a vertical strip 4*c*, there is provided an extension line 4*e* extending from the vicinity of the midpoint of the vertical strip 4*c* to the vicinity of the left edge of the flange in a leftward horizontal direction when viewed from car exterior, and the extension line 4*e* was connected to a first feed point 7.

In the FM broadcast wave receiving antenna 5, there are provided two horizontal strips 5*a*, 5*b* extending from a second feed point 8 formed in the vicinity below the first feed point, and, in a manner to interpose a portion of the left end side of the horizontal strip 4*b* that is closer to the heating strips 2*a* of the AM broadcast wave receiving antenna 4 between the two horizontal strips 5*a*, 5*b*, they have made to be vertically adjacent to achieve capacitive coupling.

There was provided a connection from the first feed point 7 of the AM broadcast wave receiving antenna 4 to the tuner 14 via an AM radio broadcast wave band amplifier 10, and there was provided a direct connection from the second feed point of the FM broadcast wave receiving antenna 5 to the tuner 14, not via an FM broadcast wave amplifier or impedance matching circuit.

The glass plate 1 is generally trapezoidal, and its size is that the upper edge is 1,100 mm, the lower edge is 1,300 mm, and the height is 800 mm.

The strip length of each antenna 4, 5 of the present invention is as follows.

The length of the horizontal strip 4*a* of the AM broadcast wave receiving antenna 4=1000 mm, The length of the horizontal strip 4*b*=750 mm, The length of the vertical strip 4*c*=155 mm, The length of the extension line 4*e*=550 mm The position of the vertical strip 4*c* is connected to the midpoint of the horizontal strip 4*a* and to 300 mm from the right end portion of the horizontal strip 4*b*. The position of the extension line 4*e* is at a position that is 85 mm away from the horizontal strip 4*a* and 70 mm away from the horizontal strip 4*b*.

On the other hand, the lengths of the horizontal strips 5*a*, 5*b* of the FM broadcast wave-receiving antenna 5 are respectively 300 mm. They are adjacent to the horizontal strip 4*b* by a length of 100 mm from the left end of the horizontal strip 4*b* of the AM broadcast wave-receiving antenna 4. The distances between the horizontal strips 5*a*, 5*b* of the FM broadcast wave-receiving antenna 5 and the horizontal strip 4*b* are each 7 mm.

The horizontal strip 4*a* of the AM broadcast wave receiving antenna 4 was made to be 20 mm away from the upper edge side inside of the flange not shown in the drawings. The horizontal strip 4*b* was made to be 30 mm away from the heating strip 2*a* on the uppermost side.

Furthermore, a conventional FM sub-antenna 6 was formed on a blank space below the defogging heating strips 2 to be adjacent to the horizontal strip 2*c* extended from the bus bar 3 of the defogging heating strips 2, thereby achieve a diversity reception with the FM broadcast wave receiving antenna 5.

These AM broadcast wave receiving antenna 4, the FM broadcast wave receiving antenna 5, the FM broadcast wave receiving sub-antenna, the heating conductive strips 2, each feed point and bus bars are formed by printing on the glass plate surface by a conductive paste such as silver paste and then baking.

The thus obtained window glass plate was installed on a vehicular rear window. Furthermore, as shown in FIG. 8, there was connected from the first feed point of the AM broadcast wave receiving antenna 4 to the AM broadcast wave band amplifier by a feeder line. In the FM broadcast wave receiving antenna 5, there was connected from the second feed point 8 to the output terminal of the AM broadcast wave band amplifier 10 via the AM band shielding capacitor 13, and there was connected to the tuner 14 by a feeder line under a condition that AM broadcast radio wave band radio waves and FM broadcast wave band radio waves have been combined.

There is provided a structure in which the first feed point 1 is connected to the tuner 14 through the AM broadcast wave band amplifier 10 in such AM broadcast wave receiving antenna 4, in which the AM band shielding capacitor 13 is connected to the second feed point in the FM broadcast wave receiving antenna 5, and in which there is connected to the tuner 14 by making it amplifier-less in FM band.

As a result of diversity reception a two-system antenna between the FM antenna 5 connected to the feed point 8 and the FM sub-antenna 6 connected to the feed point 9, the average reception gain of an FM broadcast wave band of 76 MHz to 90 MHz became −15.8 dB (dipole ratio). Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

As shown in FIG. 1, such AM broadcast wave receiving antenna and an FM broadcast wave receiving antenna have been made adjacent to achieve a capacitive coupling. With this, it became unnecessary to have an FM broadcast wave receiving amplifier and an impedance matching circuit and became only necessary to install an AM broadcast wave receiving amplifier and an AM band shielding condenser, without lowering the reception property of each of AM broadcast waves and FM broadcast waves.

In this case, the amplifier is only for AM. Therefore, as compared with a case in which two amplifiers are necessary for AM and FM, the total volume occupied by the amplifier became compact by a factor of several numbers, and it became possible to greatly reduce the production cost.

Example 2

In Example 2 shown in FIG. 2, the first feed point 7 of the AM broadcast receiving antenna and the second feed point 8 of the FM broadcast wave receiving antenna are formed at a position close to the right side vertical lateral edge of the flange, when the vehicular rear window glass 1 is viewed from vehicle exterior. The AM broadcast wave receiving antenna 4 and the FM broadcast wave receiving antenna 5 are at a generally symmetrical position relative to Example 1. The points different from Example 1 are only the strip length and the distance.

An FM sub-antenna was formed on a blank space below the heating conductive strips. A third feed point was formed below the right bus bar, and a horizontal strip extending horizontally was formed to be adjacent to the bottom line of the heating strips.

The strip lengths of each antenna 4, 5 of the present invention are as follows.

The length of the horizontal strip 4*a* of the AM broadcast wave receiving antenna 4=1000 mm, The length of the horizontal strip 4*b*=900 mm, The length of the vertical strip 4*c*=150 mm, The length of the extension line 4*e*=600 mm The position of the vertical strip 4*c* is connected to the midpoint of the horizontal strip 4*a* and to 500 mm from the right end portion of the horizontal strip 4*b*. The position of the extension line 4*e* is at a position that is 80 mm away from the horizontal strip 4*a* and 70 mm away from the horizontal strip 4*b*.

On the other hand, the lengths of the horizontal strips 5*a*, 5*b* of the FM broadcast wave receiving antenna 5 are respectively 300 mm. They are adjacent to the horizontal strip 4*b* by a length of 200 mm from the right end of the horizontal strip 4*b* of the AM broadcast wave receiving antenna 4. The distances between the horizontal strips 5*a*, 5*b* of the FM broadcast wave receiving antenna 5 and the horizontal strip 4*b* are each 10 mm. The other strips and distances are the same as those of Example 1.

By the present example, similar to Example 1, the reception gain of a domestic FM broadcast wave receiving antenna 5 of a frequency of 76 MHz to 90 MHz became −15.6 dB. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

Example 3

In Example 3 shown in FIG. 3, there is provided an antenna used as a North America FM broadcast wave receiving antenna 5 of a frequency of 88-108 MHz band, and it has a modified pattern in which only respective strip lengths are different from those of Example 1.

The strip lengths of each antenna 4, 5 of the present invention are as follows.

The length of the horizontal strip 4*a* of the AM broadcast wave receiving antenna 4=900 mm, The length of the horizontal strip 4*b*=800 mm, The length of the vertical strip 4*c*=155 mm, The length of the extension line 4*e*=560 mm The position of the vertical strip 4*c* is connected to the midpoint of the horizontal strip 4*a* and to 300 mm from the right end portion of the horizontal strip 4*b*. The position of the extension line 4*e* is at a position that is 85 mm away from the horizontal strip 4*a* and 70 mm away from the horizontal strip 4*b*.

On the other hand, the lengths of the horizontal strips 5*a*, 5*b* of the FM broadcast wave receiving antenna 5 are respectively 180 mm. They are adjacent to the horizontal strip 4*b* by a length of 120 mm from the left end of the horizontal strip 4*b* of the AM broadcast wave receiving antenna 4. The other strips and distances are the same as those of Example 1.

The present example had the same pattern as that of Example 1. When it was used as a North America FM broadcast wave receiving antenna 5 of a frequency of 88-108 MHz band, the reception gain became −16.7 dB. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

Example 4

Example 4 shown in FIG. 4 provides a modified pattern of Example 3 provided with an additional horizontal strip formed by extending the extension line of Example 3 in a direction away from the first feed point from the vertical strip.

The strip lengths of each antenna 4, 5 of the present invention are as follows.

The length of the horizontal strip 4*a* of the AM broadcast wave receiving antenna 4=900 mm, The length of the horizontal strip 4*b*=800 mm, The length of the vertical strip 4*c*=155 mm, The length of the extension line 4*e*=580 mm The length of the horizontal additional strip 4*d*=250 mm On the other hand, the lengths of the horizontal strips 5*a*, 5*b* of the FM broadcast wave receiving antenna 5 are respectively 190 mm. They are adjacent to the horizontal strip 4*b* by a length of 110 mm from the left end of the horizontal strip 4*b* of the AM broadcast wave receiving antenna 4. The other strips and distances are the same as those of Example 3.

The present example had the same pattern as that of Example 3. When it was used as a North America FM broadcast wave receiving antenna 5 of a frequency of 88-108 MHz band, the reception gain became −16.1 dB. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

Example 5

In Example 5 shown in FIG. 5, the AM broadcast wave receiving antenna 4 is completely the same as that of Example 1, and the FM broadcast wave receiving antenna 5 is one in which only one horizontal strip 5*b* was selected from the horizontal strips of the FM broadcast wave receiving antenna 5 connected to the second feed point of Example 1, and in which an end portion of the horizontal strip 5*b* was made to be adjacent to a portion of the left end side of the horizontal strip 4*b* on the side close to the heating strips 2*a* of the AM broadcast wave receiving antenna 4 to achieve capacitive coupling.

The horizontal strip 5*b* of the FM broadcast wave receiving antenna 5 of the present invention has a length of 300 mm and is made to be adjacent to the horizontal strip 4*b* by a length of 100 mm from the left end of the horizontal strip 4*b* of the AM broadcast wave receiving antenna 4. The other strips and distances are the same as those of Example 1.

By the present example, similar to Example 1, the reception gain of the domestic FM broadcast wave receiving antenna 5 of a frequency of 76-90 MHz became −16.4 dB. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

Example 6

Figure 6:
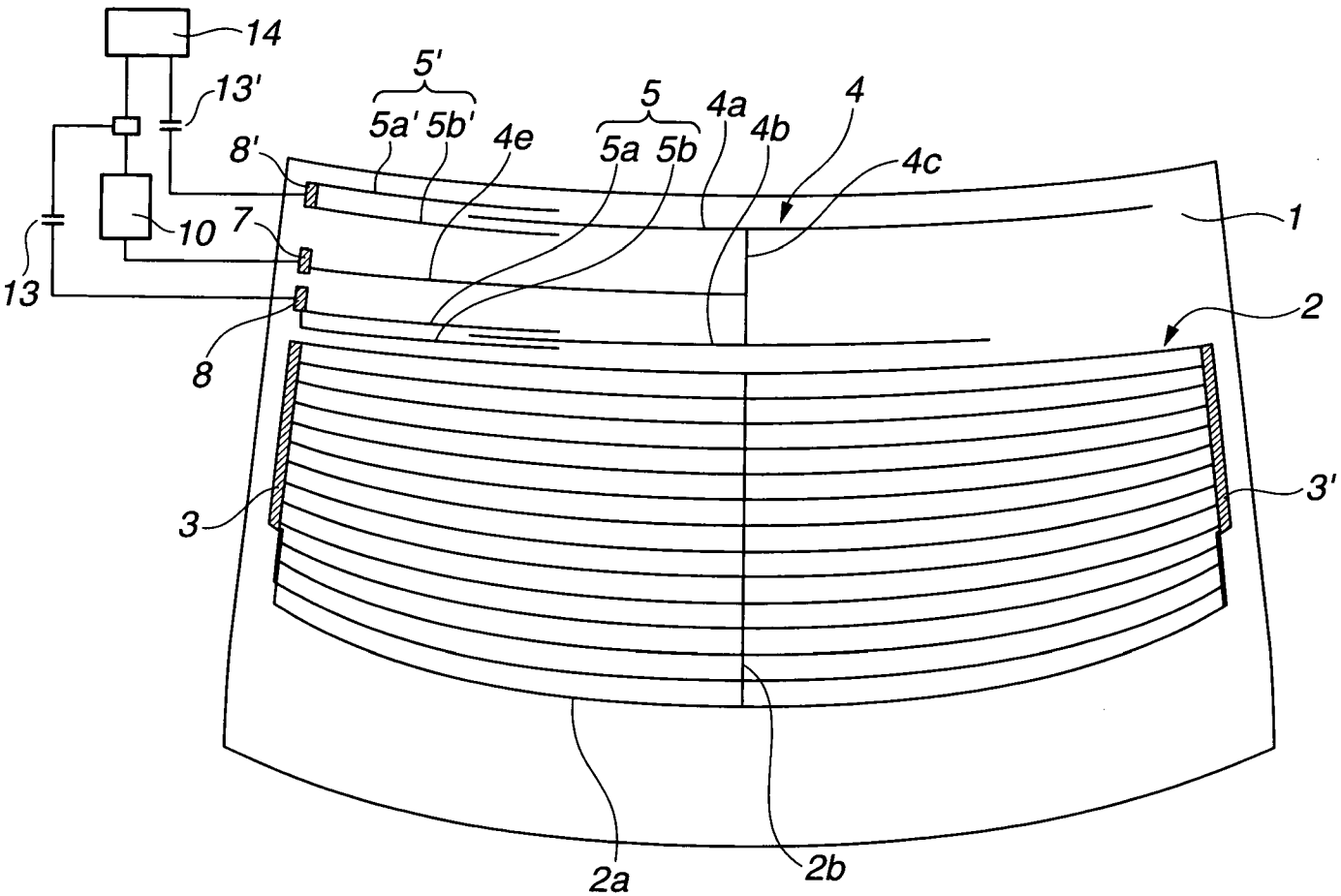
FIG. 6 is a front view showing Example 6 formed on a vehicular rear window glass of the present invention.

The AM broadcast wave receiving antenna 4 of Example 6 shown in FIG. 6 is the same as that of Example 1 of FIG. 1, except in that the length of the horizontal strip 4*a* is 880 mm. Furthermore, the FM broadcast wave receiving antenna 5 is completely the same as that of Example 1 of FIG. 1.

Furthermore, in place of the FM broadcast wave receiving sub-antenna 6 of FIG. 1, there is provided an FM broadcast wave receiving sub-antenna 5' that vertically interposes between two horizontal strips 5*a*', 5*b*' an end portion of the left side of the horizontal strip 4*a* on the upper edge window frame side of the AM broadcast wave receiving antenna 4 by making them adjacent to achieve a capacitive coupling.

The lengths of the horizontal strips 5*a*, 5*b* of the FM broadcast wave receiving antenna 5 and the horizontal strips 5*a*', 5*b*' of the FM broadcast wave receiving antenna 5' of the present invention are each 300 mm. Each of them is adjacent to the horizontal strip 4*a*, 4*b* by a length of 100 mm from the left end of the horizontal strip 4*a*, 4*b* of the AM broadcast wave receiving antenna 4. The other strips and distances are the same as those of Example 1.

In Example 6, there are provided two FM broadcast wave receiving antennas 5, 5', as compared with Example 1. By these FM broadcast wave receiving antennas 5, 5', the reception gains of the domestic FM broadcast wave receiving antenna 5 of a frequency of 76-90 MHz band became −16.8 dB and −17.2 dB, respectively. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

There was provided a connection from the first feed point of the AM broadcast wave receiving antenna 4 to the AM broadcast wave band amplifier by a feeder line, and there was provided a connection of the FM broadcast wave receiving antenna 5 from the second feed point 8 to an output terminal of the AM broadcast wave band amplifier 10 via the AM band shielding condenser 13, thereby providing a connection to the tuner 14 by feeder lines in a condition that AM broadcast radio wave band radio waves and FM broadcast band radio waves were combined.

Furthermore, with respect to the FM broadcast wave receiving sub-antenna 5', there was provided a connection from a sub second feed point 8' to the tuner 14 via the AM band shielding condenser 13', thereby providing a diversity reception by the two FM broadcast wave receiving antennas 5, 5'. Therefore, there were obtained higher reception property and directional property.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

Example 7

In Example 7 shown in FIG. 7, the AM broadcast wave receiving antenna 4 and the FM broadcast wave receiving antenna 5 are completely the same as those of Example 1 of FIG. 1. A different point is that, in place of the FM broadcast wave receiving sub-antenna 6 of FIG. 1, there is provided an FM broadcast wave receiving sub-antenna 5' that vertically interposes between two horizontal strips 5*a*', 5*b*' an end portion of the right side of the horizontal strip 4*b* on the side of the AM broadcast wave receiving antenna 4 close to the heating strips 2*a* by making them adjacent to achieve a capacitive coupling.

The lengths of the horizontal strips 5*a*, 5*b* of the FM broadcast wave receiving antenna 5 and the horizontal strips 5*a*', 5*b*' of the FM broadcast wave receiving antenna 5' of the present invention are each 300 mm. Each of them is adjacent to the horizontal strip 4*b* by a length of 100 mm from the both ends of the horizontal strip 4*a*, 4*b* of the AM broadcast wave receiving antenna 4. The other strips and distances are the same as those of Example 1.

In Example 7, there are provided two FM broadcast wave receiving antennas 5, 5', as compared with Example 1. By these FM broadcast wave receiving antennas 5, 5', the reception gains of the domestic FM broadcast wave receiving antenna 5 of a frequency of 76-90 MHz band became −16.6 dB and −16.8 dB, respectively. Although an FM broadcast wave amplifier or impedance matching circuit was not provided, it bear comparison with the average reception gain (−17 dB) in the case of forming an impedance matching circuit shown in FIG. 10, and it was sufficiently at practical level.

Since AM broadcast waves are amplified by an AM broadcast wave band amplifier in a way similar to the past, it is practically not problematic at all.

There was provided a connection from the first feed point of the AM broadcast wave receiving antenna 4 to the AM broadcast wave band amplifier by a feeder line, and there was provided a connection of the FM broadcast wave receiving antenna 5 from the second feed point 8 to an output terminal of the AM broadcast wave band amplifier 10 via the AM band shielding condenser 13, thereby providing a connection to the tuner 14 by feeder lines in a condition that AM broadcast radio wave band radio waves and FM broadcast band radio waves were combined.

Furthermore, with respect to the FM broadcast wave receiving sub-antenna 5', there was provided a connection from a sub second feed point 8' to the tuner 14 via the AM band shielding condenser 13', thereby providing a diversity reception by the two FM broadcast wave receiving antennas 5, 5'. Therefore, there were obtained higher reception property and directional property.

By such AM broadcast wave receiving antenna and an FM broadcast wave receiving antenna, it became possible to make an FM broadcast wave receiving amplifier and an impedance matching circuit unnecessary, without lowering the reception property of each of AM broadcast waves and FM broadcast waves.

The invention claimed is:

1. An antenna formed on at least upper blank space of defogging heating strips of a rear window glass of a vehicle, the antenna being a vehicular glass antenna comprising an AM broadcast wave receiving antenna which has at least two horizontal strips formed to have a space therebetween, and a vertical strip connecting the two horizontal strips in the vicinity of a midpoint of each horizontal strip, and in which an extension line extends in a horizontal direction from the vicinity of a midpoint of the vertical strip to the vicinity of a vertical edge of a flange and connects to a first feed point; and an FM broadcast wave receiving antenna having at least one horizontal strip extending from a second feed point formed in the vicinity of the first feed point, and characterized in that at least one horizontal strip of the FM broadcast wave receiving antenna is adjacent to one end of either horizontal strip of the two horizontal strips of the AM broadcast wave receiving antenna to achieve a capacitive coupling.

2. A vehicular glass antenna according to claim 1, which is characterized in that the FM broadcast wave receiving antenna is formed at each of at least two positions of end portions of the two horizontal strips of the AM broadcast wave receiving antenna to achieve a capacitive coupling and to achieve a diversity reception by the at least two FM broadcast wave receiving antennas.

3. A vehicular glass antenna according to claim 1, which is characterized in that a horizontal additional strip is formed from the vicinity of the midpoint of the vertical strip of the AM broadcast wave receiving antenna in a direction opposite to the first feed point.

4. A vehicular glass antenna according to claim 1, which is characterized in that there is provided a connection from the first feed point of the AM broadcast wave receiving antenna to a tuner via an AM radio broadcast wave amplifier, and that there is provided a direct connection from the second feed point of the FM broadcast wave receiving antenna to the tuner not via an amplifier or impedance matching circuit.

5. A vehicular glass antenna according to claim 1, which is characterized in that each strip from the second feed point of the FM broadcast wave receiving antenna has a length of 200-400 mm, when it is used as an FM broadcast wave receiving antenna of a frequency of 76-90 MHz band, and has a length of 150-300 mm, when it is used as an FM broadcast wave receiving antenna of a frequency of 88-108 MHz band, that a strip length of a portion at which the horizontal strip of the FM broadcast wave receiving antenna and the horizontal strip of the AM broadcast wave receiving antenna are made to be adjacent to each other to achieve a capacitive coupling is 50-300 mm, and that the strips of the portion at which they are adjacent to achieve a capacitive coupling have a distance of 5-30 mm.

6. A vehicular glass antenna according to claim 1, which is characterized in that an FM broadcast wave receiving sub-antenna is formed on a blank space below the defogging heating strips, thereby achieving a diversity reception with the FM broadcast wave receiving antenna.

7. A vehicular glass antenna according to claim 1, which is characterized in that, in addition to the two horizontal strips of the AM broadcast wave receiving antenna, between the horizontal strips there are formed one or two horizontal strips that are perpendicular to the vertical strip.

* * * * *